US006694879B2

(12) United States Patent
Schuster et al.

(10) Patent No.: US 6,694,879 B2
(45) Date of Patent: Feb. 24, 2004

(54) ERASING AND CLEANING DEVICE FOR CYLINDERS, IN PARTICULAR PRINTING-FORM AND RUBBER-BLANKET CYLINDERS OF A PRINTING MACHINE

(75) Inventors: Alfons Schuster, Augsburg (DE); Thomas Hartmann, Neusäss-Westheim (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/792,658

(22) Filed: Feb. 23, 2001

(65) Prior Publication Data

US 2001/0029861 A1 Oct. 18, 2001

(30) Foreign Application Priority Data

Feb. 23, 2000 (DE) ..... 100 08 214

(51) Int. Cl.[7] ..... B41F 35/00
(52) U.S. Cl. ..... 101/425; 101/424
(58) Field of Search ..... 101/423, 425, 101/424, 483, 484; 399/123, 34, 35, 345, 343; 134/151, 137; 15/256.51, 256.52

(56) References Cited

U.S. PATENT DOCUMENTS

| | | | | | |
|---|---|---|---|---|---|
| 4,555,989 | A | * | 12/1985 | Marass et al. | 101/424 |
| 4,986,182 | A | * | 1/1991 | Sawaguchi et al. | 101/425 |
| 5,105,740 | A | | 4/1992 | Loos et al. | 101/425 |
| 5,275,104 | A | * | 1/1994 | Corrado et al. | 101/425 |
| 5,390,602 | A | | 2/1995 | Göri | 101/425 |
| 5,450,792 | A | * | 9/1995 | Gegenheimer et al. | 101/425 |
| 5,519,914 | A | * | 5/1996 | Egan | 15/256.53 |
| 5,537,924 | A | | 7/1996 | Krause | 101/423 |
| 5,727,470 | A | | 3/1998 | Kurzer et al. | 101/425 |
| 5,753,048 | A | | 5/1998 | Lippold et al. | 134/18 |
| 5,762,000 | A | * | 6/1998 | Detmers | 101/425 |
| 5,842,418 | A | * | 12/1998 | Corrado et al. | 101/425 |
| 5,894,800 | A | | 4/1999 | Bar et al. | 101/425 |
| 5,964,007 | A | * | 10/1999 | Wisniewski et al. | 101/425 |

FOREIGN PATENT DOCUMENTS

| | | | |
|---|---|---|---|
| DE | 39 09 119 | 9/1990 | |
| DE | 42 11 310 | 10/1993 | |
| DE | 43 19 258 | 12/1994 | |
| DE | 44 42 412 | 5/1996 | |
| DE | 44 43 356 | 6/1996 | |
| DE | 195 43 518 | 5/1997 | |
| EP | 0 315 144 | 5/1989 | B41F/35/04 |
| EP | 520 521 | 12/1992 | |
| EP | 611 652 | 8/1994 | |
| EP | 693 371 | 1/1996 | |
| JP | 62-055094 | 3/1987 | C12P/7/44 |
| JP | 1-22437 | 5/1989 | B41F/35/06 |
| JP | 8-207261 | 8/1996 | B41F/35/06 |
| JP | 9-164664 | 6/1997 | B41F/35/06 |

* cited by examiner

*Primary Examiner*—Anthony H. Nguyen
(74) *Attorney, Agent, or Firm*—Cohen, Pontani, Lieberman & Pavane

(57) ABSTRACT

In an erasing and cleaning device for cylindrical surfaces, in particular of printing-form and rubber-blanket cylinders of a printing machine, with the aid of a cleaning cloth capable of being moved by cleaning-cloth transport means, the cleaning-cloth transport means comprising a fresh-cloth roll, a pressure element, which presses the cleaning cloth against the cylindrical surface, and a dirty-cloth roll for receiving the spent cleaning cloth and cooperating with a positioning unit for the operating position and a drive, to make it easier to change the cleaning cloth and to achieve a reduction in the time taken by this change and, moreover, to make this erasing and cleaning device capable of being used universally, there is provision for the cleaning-cloth transport means together with the cleaning cloth, to be packaged in an independent cassette and to be exchangeable in this form and for the positioning unit, in the form of a running mechanism with a drive for the cassette, to be arranged permanently as a module in the printing machine.

21 Claims, 4 Drawing Sheets

ERASING AND CLEANING DEVICE FOR CYLINDERS, IN PARTICULAR PRINTING-FORM AND RUBBER-BLANKET CYLINDERS OF A PRINTING MACHINE

BACKGROUND OF THE INVENTION

1. Field of the Invention

The invention relates to an erasing and cleaning device for the cleaning of cylindrical surfaces, in particular the surfaces of printing-forme and rubber-blanket cylinders inside and outside of printing machines, with the aid of a cleaning cloth capable of being guided by cleaning-cloth transport means.

2. Description of the Related Art

In the field of printing technology, as is known, in the devices often used for cleaning cylindrical surfaces a cloth is guided past the surface of a rotating cylindrical object, and this cloth, impregnated with cleaning agent, takes up the dissolved-on and dissolved substances from the printing forme and transports them away. The cloth is unwound from a fresh-cloth roll and, after use, is wound up on a dirty-cloth roll.

A cleaning system for printing formes is known, for example, from the publication DE 44 42 412 A1, which discloses a method and a device for controlling the washing mode in a printing machine. The object to be achieved in that publication is based on the recognition that the feed for the cleaning cloth must be controlled more accurately, more reliably and in a more versatile way. This object is achieved, in that publication, essentially in that the cleaning-cloth transport receives via a sensor, from a clocked gearwheel, travel-proportional pulses which are used to control the drive motors for the transport means of the cleaning cloth, so that the respective transport travels of the cleaning cloth can be kept constant.

In order to achieve defined transport travels, the transport travel of the cleaning cloth in the forward and backward directions is detected by a tracer means having a rubber wheel rolling on the cleaning cloth. An exchangeable so-called push-in washing unit has a tracer means in the form of a clocking shaft, on which the cleaning cloth rolls, and a sensor which is fastened to the printing machine and which senses a toothed clocking wheel connected to the clocking shaft, the thickness of the clean-cloth roll also being sensed by a resiliently pressed-on tag which cooperates mechanically with a second machine-side sensor.

With the push-in washing unit inserted, the drums can be driven by a single motor which is arranged on the printing machine and, depending on the direction of rotation of said motor, rotates either one drum or the other, as is known per se from EP 0 520 521 A1.

A measure, which is simple to form, for the transport speed of the cleaning cloth is the frequency of signals obtained from regular markings which are formed on the tracer means.

The above-mentioned known arrangement requires a separate control mechanism which necessitates an outlay in terms of material and of maintenance.

EP 0 693 371 B1 describes a forme cylinder which has an anodized or brushed seamless aluminium or chromium surface. It is imaged by the thermotransfer method. Provided on the circumference is a device which serves for removing the printing image after the printing process has ended.

After the printing process has ended, a directly imaged printing forme of the type, which consists of materials, such as, for example, a ceramic, a glass or a metal, or has at least one surface layer consisting of one of these materials, can be erased within the printing machine in the way described there. This erasing and hydrophilic means is permanently installed in the printing assembly and is arranged on the circumference of the forme cylinder having a directly imageable printing forme. It has a cleaning device which can be thrown onto and off the printing forme. The cleaning device operates by means of a cleaning cloth or cleaning fleece which is pressed against the printing forme by a supply roller via a pressure roller and is subsequently wound up onto a winding roller. The pressure roller is likewise mounted rotatably, for example in an oscillating head. When a cleaning fluid or another agent, which serves either for erasing the printing image applied to the printing forme and for the removal of printing-ink residues or for hydrophilizing, that is to say conditioning the surface of the printing forme, is applied to said printing forme from nozzles which are located upstream of the cleaning device in the direction of rotation of the forme cylinder, this agent can be taken up, together with the dirt detached by it, by the cleaning cloth when the pressure cylinder presses the pressure roller against the printing forme and the cleaning cloth is moved past the printing forme. The nozzles are preferably angularly adjustable and spray the media either directly onto the printing forme or onto the cleaning cloth. The pressure roller is preferably rubber-coated. The cleaning cloth is wound from the supply roller onto the winding roller either in portions or continuously. The pressure with which the cleaning cloth is pressed against the printing forme is preferably also variably adjustable.

By contrast, EP 0 611 652 B1 shows a cleaning device for cleaning the surface of the rubber blanket of a rubber-blanket cylinder. It likewise comprises essentially a fresh-cloth roller and a dirty-cloth roller for receiving a cleaning cloth which is impregnated with washing fluid and is drawn off from the fresh-cloth roller to the dirty-cloth roller. In this case, the cleaning cloth is always held under tension stress by pressure means.

The cleaning device is designed, there, as a push-in unit system and, in the pushed-in state, is assigned to the cylindrical body produced in the form of a rubber-blanket cylinder. The cleaning device is brought into or out of contact with the rubber-blanket cylinder via a throw-on device. A washing-fluid supply is assigned to the cleaning device fixedly in relation to the machine. The fresh-cloth roller, the washing roller and the dirty-cloth roller are rotatably mounted in two side parts arranged parallel to one another. The washing roller has a shaft which possesses an elastic coating and which serves as a pressure element for pressing the cleaning cloth onto the cylindrical body and at the same time guiding the cleaning cloth. The side parts of the push-in unit system are connected to one another via a crossmember. The cleaning cloth is guided by the fresh-cloth roller at as large a looping angle as possible over the washing roller in the pulling direction of the dirty-cloth roller. The cleaning cloth is wetted via a washing fluid. Drive is imparted to the dirty-cloth roller via a shaft and gearwheel. The dirty-cloth rollers operated intermittently and pulls off the cleaning cloth from the fresh-cloth roller in the pulling direction via the washing roller, which brings the cleaning cloth into contact with the cylindrical body to be cleaned, and receives the cleaning cloth on a shaft.

The cleaning cloth running off from the stock roll on a clean-cloth spindle is guided on the outside around the pressure element which is arranged so as to be linearly movable and which consists of an elastic material.

During the change of cleaning cloth, hitherto the front end of the cloth web has had to be pulled through the washing device by hand and guided via the deflections on the outside around the pressure element to the dirty-cloth roll and secured to the latter.

SUMMARY OF THE INVENTION

The object of the present invention is to make it easier to change the cleaning cloth and to reduce the time taken up by this change and, moreover, to design an erasing and cleaning device in such a way that it can be used universally.

Since all the cleaning-cloth transport means, together with the cleaning cloth, are packaged in an independent cassette and a modular positioning unit can be arranged permanently in the printing machine, universal use of the cassette in the printing machine for any desired cylinder is possible, and it is merely necessary to provide a positioning unit. A particular advantage, as compared with the push-in unit system described in the introduction with regard to the prior art, is also to be seen in that the cleaning device no longer has to be exchanged completely, but, instead, only the independent cassette has to be taken out of the positioning unit, thus greatly simplifying the change, not simply in terms of time.

The device for erasing and cleaning cylindrical surfaces comprises a fresh-cloth roll, a dirty-cloth roll for receiving the spent cleaning cloth and a pressure element, in particular a pressure roller, which presses the cloth against a cylindrical surface. In a particularly advantageous way, a transport device is arranged on the path between the fresh-cloth roll and the pressure roller and an identically designed transport device is arranged on the path from the pressure roller to the dirty-cloth roll, these transport devices comprising devices 3' and 3" which are similar to transport belts and between which the cleaning cloth runs, on the one hand the devices 3" being equipped with mechanical means which ensure a take-up of the cleaning cloth, and, on the other hand, the devices 3' being controlled synchronously via drive devices. The elements 1–4 and 6 are, in turn, arranged in a cassette. A cassette is thus provided which ensures the synchronization of the cleaning cloth in a simple way, the cleaning and erasing device as a whole therefore being less susceptible to faults and requiring lower maintenance.

The advantageous arrangement of active transport devices for the cleaning cloth both in the region of the fresh-cloth roll and pressure roller and between the pressure roller and dirty-cloth roll ensures, at any moment, an equal feed and a uniform tension of the cloth between the three rollers, so that, for example, non-uniformity in transport due to the decrease in roll thickness on the fresh-cloth roll is compensated.

Moreover, the direction of the cloth can be reversed in a simple way without difficulty. Thus, for example, fresh-cloth roll and dirty-cloth roll need to be operated with slip merely via conventional take-up drives which wind up and unwind the cloth and ensure sufficient tension between the transport devices 3' and 3" according to the invention and the respective rollers.

The active transport device 3' has, on its surface, gripping means which can engage into the fleece of the cleaning cloth and thus move it forwards. These gripping means may consist of fine hooklets, in a similar way to a touch-and-close fastening, but may also be other roughnesses, for example knobs or needles, or may consist of profiled rubber. The device 3" similar to a transport belt forms a passive abutment for the active transport device 3' and may consist, for example, of an elastomeric band. In a further embodiment, this band may also be provided with take-up means and be actively operated synchronously with the devices 3' via a further drive.

By such gripping cloth transport being used, the mechanical properties of the cleaning cloth are relatively independent of the mechanical requirements of the cloth transport device. Furthermore, the transport travel is independent of the angular diameter of the fresh-cloth and dirty-cloth rolls, while the drive may take place both continuously and in steps.

Contact between the cylindrical surface, for example of a printing forme, and a cloth, is made via the pressure roller, for example an elastic rubber roller. In a preferred embodiment, this elastic rubber roller may likewise be driven synchronously.

By means of the cleaning device according to the invention, a cleaning cloth can be used both as a single piece or as a perforated band. The cylinder segment required (active cleaning surface) may be small and variable. Any desired cleaning-cloth rolls may be used in the application, since the mechanically gripping transport devices are independent of the physical and chemical nature of the cleaning cloth. As compared with known devices, there is no complicated control carried out, for example, via sensors. The control of the drives for devices 3' and 3" and, if appropriate, pressure roll 4 is restricted merely to the synchronous behavior which is directly predetermined.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
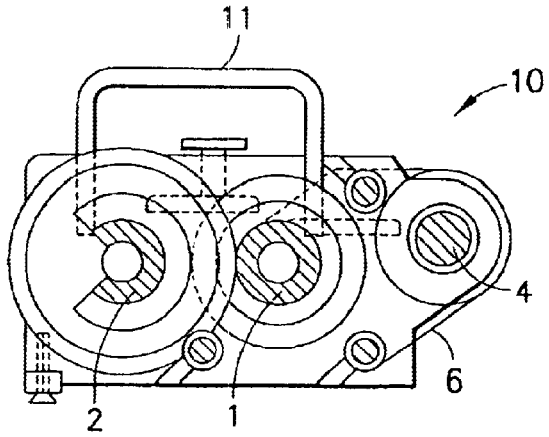
FIG. 1 depicts the cleaning-cloth transport means employed in to the invention and which are housed in an exchangeable cassette.

Referring to FIG. 1, the cleaning-cloth transport means of an exemplary embodiment of the erasing and cleaning device according to the invention for cylindrical surfaces 5 comprise a fresh-cloth roll 1, a pressure roller 4 and a dirty-cloth roll 2 which are all packaged in an independent cassette 10. A continuous cleaning cloth 6 can be unwound from the fresh-cloth roll and be supplied to the dirty-cloth roll 2 via the pressure roller 4.

The pressure roller 4 has in a known way an elastomeric covering consisting, in particular, of latex (natural rubber), silicone, styrene/butadiene (BUNA 5), ethylene/propylene, isobutylene/isoprene (butyl rubber), fluorine (Viton® A, B) or polychloroprene elastomer or their mixtures.

The covering of the pressure roller 4 preferably has a roughness with Ra values of between 0.4 and 35 $\mu$m (white-light interferometer) and a hardness according to Shore A (DIN 53 505) of between 30 and 80 and, in particular, of between 30 and 50. The covering must also be pore-free.

The cassette 10 is designed as an exchangeable unit, that is to say the cleaning cloth 6 is changed by such an independent unit in the form of the cassette 10 being replaced. To make this exchange of a cassette 10 easier, grips 11 are attached on both sides, that is in the region of the two end faces, and the operator can grasp these grips and thus pull the complete cassette out of the printing machine or insert it into the latter.

Figure 2A:
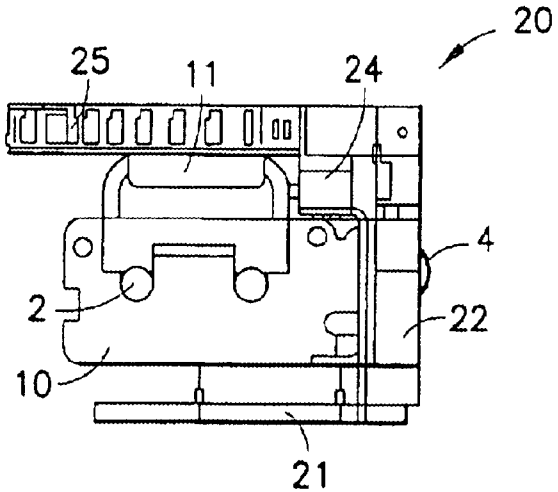
FIG. 2*a* shows the cassette on the positioning device fixed in the printing machine.

FIG. 2*a* shows the cassette on a positioning device 20 or unit which is arranged permanently in the printing machine and can cooperate with the inserted cassette 10, that is the cassette 10 can be placed onto the positioning unit 20 and be connected to the latter positively and non-positively, for example in the same way as a video cassette in its accompanying running mechanism, a drive for the cleaning-cloth transport means 1–4 (FIG. 4) being capable of being articulated in a known way on the positioning unit 20, so that the positioning unit 20 and the drive, not shown here, are of modular design.

A drive motor drives the cleaning cloth and is controlled by a computer program which can make it possible to execute an intermittent feed of the cleaning cloth 6 and a partial return transport after each cleaning operation and, finally, a rewinding of the spent cleaning cloth 6 from the dirty-cloth roll 2 to the fresh-cloth roll 1, as is described, for example, in EP 520 521 B1 mentioned in the introduction.

It may envisaged, in the present exemplary embodiment, to make the transport of the cleaning cloth 6 in the cassette 10 continuous or in steps by means of corresponding drives. The drive of the cleaning cloth 6 may take place, for example, via a stroke-limited pneumatic drive, in which case stroke limitation is set via a pick-up on the dirty-cloth roll 2.

However, the cleaning cloth may also be transported via an electric drive, in which case the cloth quantity per unit time could be picked up via a running wheel.

The positioning unit 20 is preferably designed as one or two slides 50 (FIG. 5) which are arranged on side parts of the printing machine and are capable of being moved by pneumatic means transversely onto the cylindrical surface 5 and of being thrown off from the latter again and on which is arranged a superstructure 22 for receiving the cassette 20, said superstructure being in the form of two side walls 22*a*, 22*b* which are connected via a crossmember 23. By means of a bolt, not shown, the cassette 20 is secured in the working position on the superstructure 22 or on the crossmember 23. Furthermore, when the cassette 10 is in the working position, the cloth stock on the fresh-cloth roll 1 is checked by sensing means (as disclosed, for example, DE 195 43 518 A1) which are brought into the functional position when the cassette 10 is pushed in. Moreover, a drip plate 21 is preferably provided below the movable slides 50 of the positioning unit 20.

The cloth 6 is brought into contact with the cylinder outer surface 5 over the cylinder width by means of the throw-on body, i.e., pressure roller 4, the exertion of force in order to achieve a frictional force being produced, as already stated, by an activatable drive.

A nozzle head 24 for supplying the cleaning agent is placed on the crossmember 23 and is connected to a movable cable guide 25 (for supplying with cleaning medium), said nozzle head being capable of being moved along the crossmember 23 parallel to the cylindrical surface 5 in a known way.

A drive via the dirty-cloth roll 2, but, which also could be onto the fresh-cloth roll 1, can be coupled to the cassette 10 received in the superstructure 20, for example as is known from EP 611 652 B1.

Figure 3:
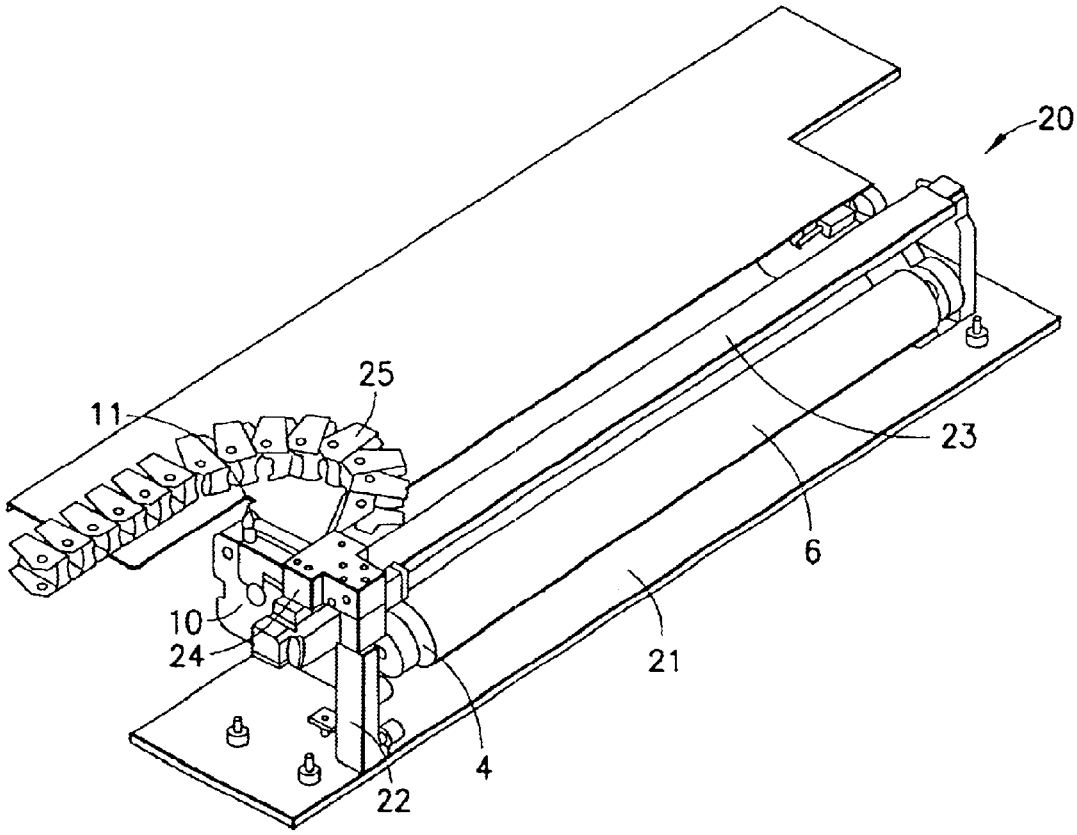
FIG. 3 is a perspective part-view of the erasing and cleaning device.
Figure 2B:
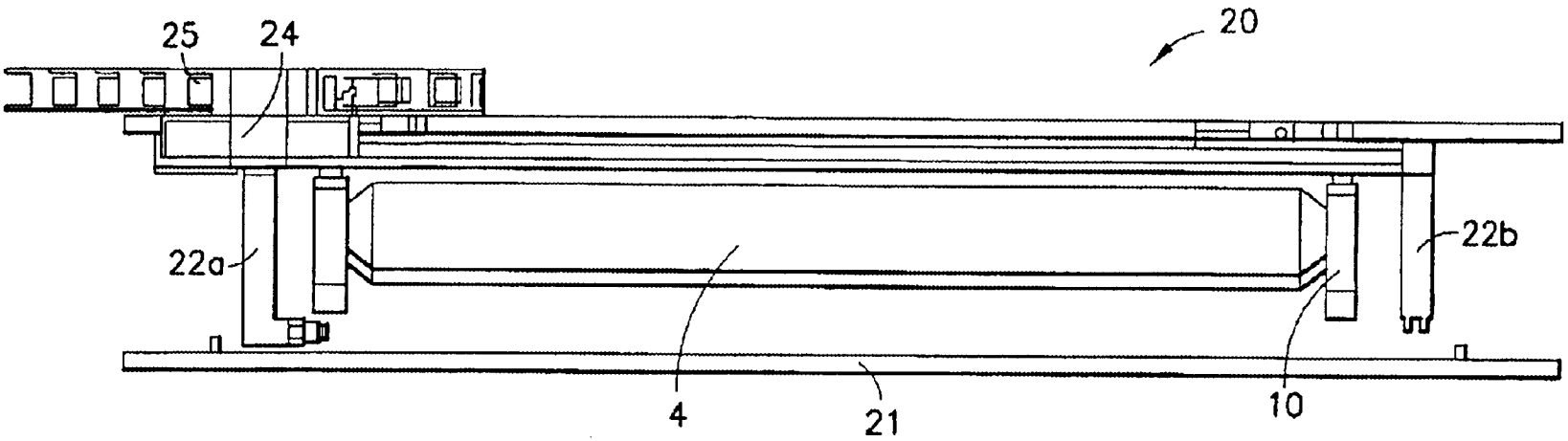
FIG. 2*b* is a view of FIG. 2*a*, as rotated through 90°.

FIGS. 2*b* and 3 show the positioning unit 20 with inserted cassette 10, with the same reference symbols in each case in various views, but which additionally illustrate that the active width of the cassette 10 and therefore the width of the cleaning cloth in the exemplary embodiment correspond to the width of the cylinder surface 5 to be cleaned.

In a particularly advantageous way, the positioning unit 20 makes it possible to position the cassette 10 or the cleaning cloth 6 in relation to the cylindrical surface 5 to be cleaned with a plurality of different, but at least with two different accessory positions, that is to say the positioning unit 20 allows a self-adjustment of the advancing movement, taking into account the format variability of the surface 5 to be cleaned.

This embraces the fact that the positioning unit 20 can be brought into an operating and a throw-off position defined in each case, and that taking into account the format variability of a cylindrical surface 5 to be cleaned necessitates a variably approachable operating position. Pressure-subjected approach positions can be sensed, for example, by means of strain gauges and can be readjusted. Furthermore, an ergonomic removal possibility, that is to say the exchange of this cassette 10, makes it necessary, in a preferred way, to have a third defined position of the positioning unit 20 in the printing machine.

However, the positioning unit preferably comprises an electromotive drive and conversion into a linear movement (for example, via gearwheels and a threaded drive). The positioning of the cassette 10 in relation to the cylindrical surface 5 to be cleaned is preferably carried out above or below ("eccentrically to") the direct horizontal connection between the centre point of the cylinder to be cleaned at the center point of the pressure roller 4. Positioning may take place via pneumatic cylinders with or without adjustable travel limiters or via regulated linear displacement with or without adjustable travel limiters.

As indicated in FIG. 3, a cleaning medium can be applied by means of the traversable nozzle head 24 transversely to the cylindrical surface 5, specifically onto the cleaning cloth 6 and/or onto the cylindrical surface 5, the nozzle head 24 being arranged pivotably on the crossmember 23. With a view to the safety aspect, travel sensors may also be provided for the nozzle head 24.

The traversable nozzle head, in turn, may, of course, also constitute a collecting device for a plurality of, various cleaning media. Thus, for example, four nozzles may be seated on a collecting vessel provided with bores.

In particular, the media quantities of a plurality of various media can be controlled independently of one another via miniature valves in the immediate vicinity of the traversable nozzle head 24, with the result that a comparatively high positioning accuracy of +/−2 mm can be achieved, particularly in the edge zones, in the case of a minimal media quantity.

The supply system for cleaning media, which can be connected to the nozzle head 24, is sufficiently known from the prior art (pressure, positive-displacement or piston pumps) and is also suitable, in particular, for supplying with a concentrate $\eta$=500 mPa·s.

Preferably, the cleaning cloth 6 executes a relative movement which runs in the opposite direction to the movement of the cylindrical surface 5 to be cleaned, the cylinder to be cleaned rotating at a speed of 5 to 55 revolutions per minute, depending, of course, on the format, while the pressure roller 4 can be moved continuously or in traversing motion, but also in the same direction, as already described, for example, in DE 44 43 356 A1. On average, the cleaning cloth moves at 1 to 5 mm per second. Thus, for this purpose, the cloth feed winds up the cloth 6 from a stock roll 1 onto the dirty roll 2. The unwinding of the cloth 6 and the direction of rotation of the cylinder 5 are preferably opposite to one another. It is also possible for them to be in the same direction. The dirt collecting in the entry nip between the cylinder 5 and the cloth 6 endeavours to escape through the pressure nip. The dirt seated in the entry nip is limited in quantity when some of it is discharged via the cloth in the intended unwinding direction of the cloth 6. The winding spindle 2 is connected on both sides to electric motors driving via worm mechanisms.

Figure 4:
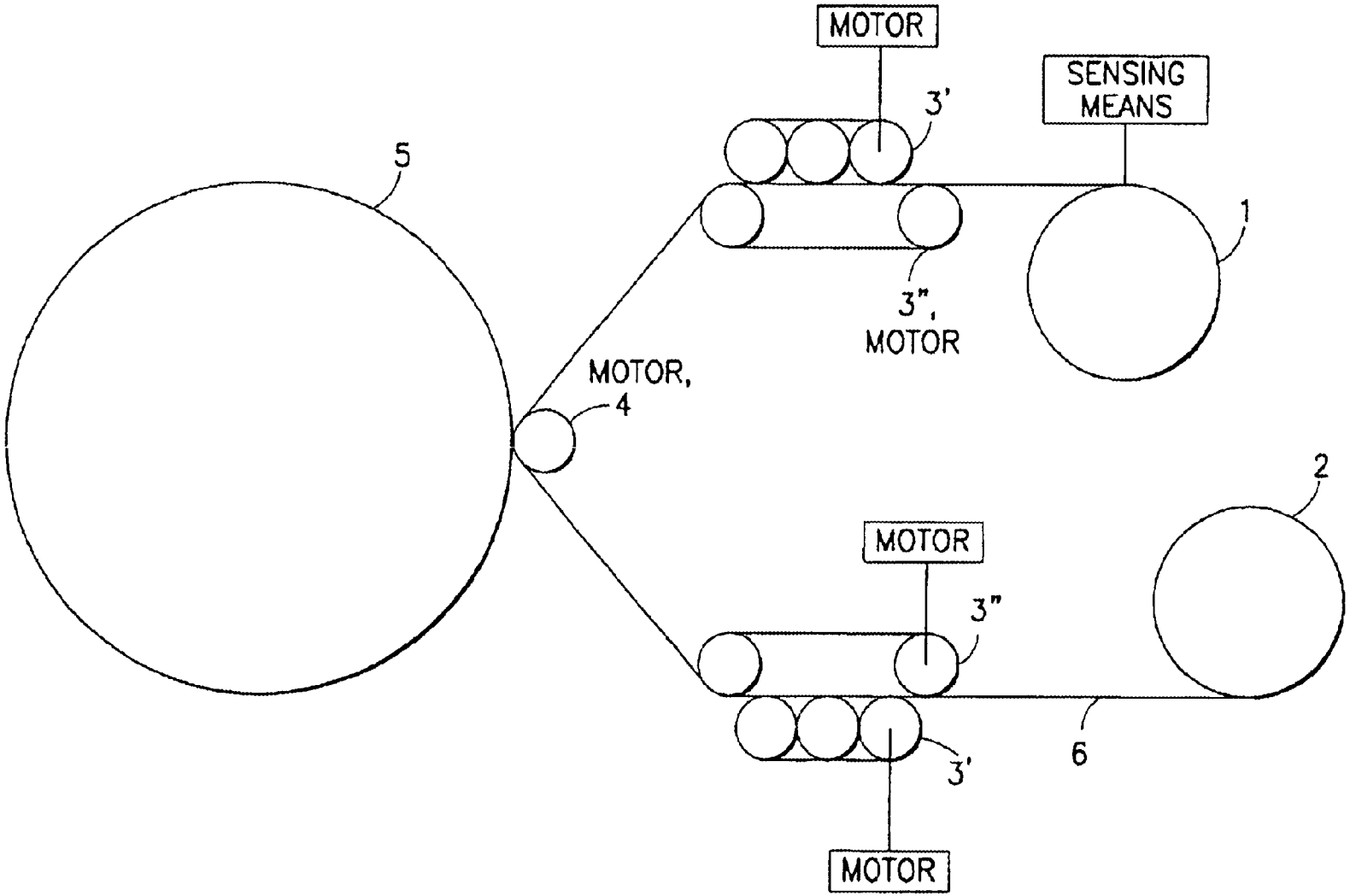
FIG. 4 is a diagrammatic view of the cassette according to the invention.

FIG. 4 shows a preferred developing embodiment of the cassette according to the invention. A cleaning cloth 6 guided between the upper pair of transport devices 3' and 3" is unwound from the fresh-cloth roll 1 and supplied to the pressure roller 4. The pressure roller 4 is subjected to pressure in the direction of the cylindrical surface 5 and the band guided between the pressure roller 4 and the cylindrical surface 5 is subsequently moved forwards by means of a lower mirror-symmetrically arranged transport device 3' and 3" and the cloth 6 is wound up on the dirty-cloth roll 2. During the operation, the fresh-cloth roll 1 does not need to be driven directly, but, instead, a simple mechanical means is sufficient to keep the cleaning cloth tensioned tautly between the upper transport device 3' and 3" and the fresh-cloth roll. The devices 3' are driven synchronously by means of electric motors. The pressure roller 4 and/or, if appropriate, device 3" is preferably likewise driven by means of an electric motor and is synchronized with the drives for 3'.

As stated, the cloth transport unit 1–4 makes it possible to have a cassette-like design (comparable to a video cassette), so that the cleaning cloth 6 can be changed together with the cassette, without the entire erasing and cleaning device having to be removed or demounted.

The erasing and cleaning device is suitable, in general, for the cleaning of cylindrical surfaces inside and outside of printing machines with the aid of a modular cloth transport unit, but can preferably be used for the cleaning of systems which, in the case of a lithographic method, make it possible to change the imaging quickly without the removal of the printing forme. Printing-on-demand systems and computer-to-plate systems are mentioned here as examples of this.

The cleaning cloth 6 consists of fibrous fleece having high wet tenacity. It has, as a rule, a width of 30 to 160 cm. The thickness depends on the mechanical properties and on the intended task (printing forme, rubber blanket, etc.). However, as a rule, it is from 0.1 to 3 cm. The cleaning cloth 6 may take the form of an endless roll. For use in the cleaning cassette, an endless or a perforated fleece ply may be employed, depending on whether the aim is to achieve continuous or batchwise consumption. The cloth 6 may therefore be employed not only in continuous endless form, but also in the form of single leaves or in folded form.

The cleaning cloth 6 should preferably have the following technical parameters. The intrinsic absorption capacity for liquid substances should be 1 to 20 ml, preferably 2 to 5 ml, per g of cloth. For polar liquid substances, for example water of drinking-water quality, the intrinsic absorption capacity is then around 1 to 8 ml/g of cloth, preferably around 2 to 6 ml/g of cloth. For non-polar substances, (for example 5W30W lubricating oil), this value is around 2 to 10 ml/g of cloth, preferably around 3 to 8 ml/g of cloth. The intrinsic absorption rate may assume values of around 0.2 to 30 ml/g/s, depending on the viscosity of the respective liquid.

The cloth 6, in the wet state, should have an essentially unchanged tensile or tearing strength. That is to say, the cloth 6 should not be distorted or even tear during the cleaning operation. The bursting strength in Mullen bursts give a measure close to practice here, and, in the wet state, should have, for example, a value of +/−40%, preferably of +/−30%, in particular −10% to +20%, ideally approximately the same value as in the dry state. For water of drinking quality (as a representative of, for example, dampening solution), 2-propanol, 2-butanone, heptane (as a representative of, for example, solvent) or 5W-30W lubricating oil (as a representative of, for example, a printing-ink base), the Mullen burst value of the fleeces treated with these liquids is in the range of 300 to 500 kPa, preferably 320 to 420 kPa. The weight specific absorptivity for the above-mentioned liquid substances is in the range of 1 to 10 ml/g, preferably 2 to 8 ml/g, in particular 2.5 to 6 ml/g of liquid. The weight per unit area of the fleece is 60 to 120 g/m$^2$, preferably 70 to 100 g/m$^2$, in particular 75 to 80 g/m$^2$.

Fleeces with a composition in a weight ratio of 30 to 45% to 70 to 55% of man-made fibre to cellulose fibre have proved suitable. The man-made fibres may be tear-resistant polymer fibres, such as polyamide, polyolefin or polyester fibres, preferably polyester fibres. The cellulose fibres are preferably conventional mechanical wood pulp.

Spun-braided fleeces are also highly suitable. These consist, as a rule, of a single material, contain no binder and absorb water, oil and solvent to a high degree. Spun-braided fleeces are, for example, those of the series Sontara EC® from DuPont. Cleaning cloths made from these fleeces have low fluffiness and remove ink and washing agent from the rubber blanket completely.

Figure 5:
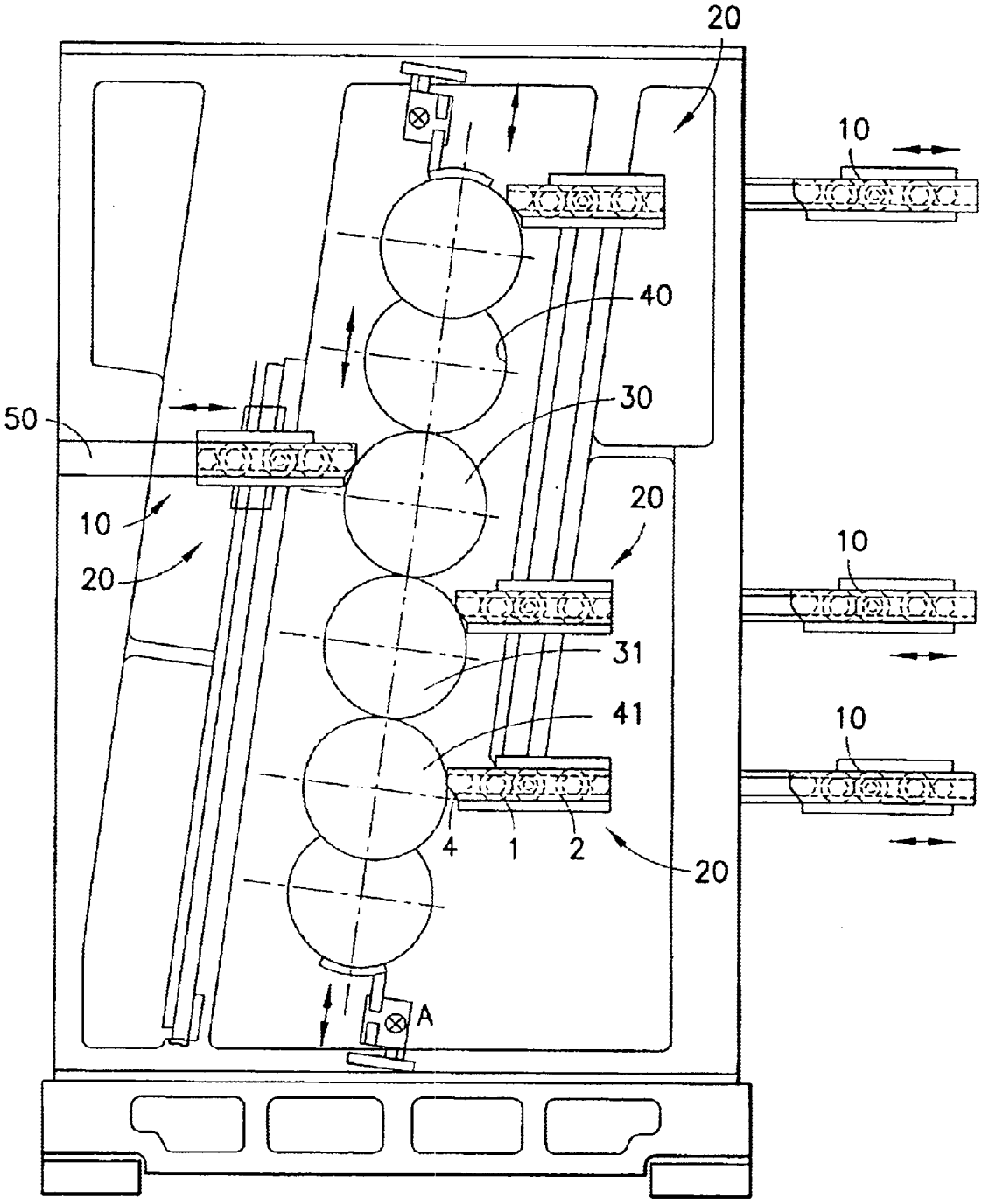
FIG. 5 shows possible arrangements of the erasing and cleaning device in the printing machine.

Finally, FIG. 5 demonstrates the various possibilities for using the modular arrangement of the positioning unit 20 with a suitable cassette 10. Thus, this can be employed accordingly for erasing and cleaning transfer cylinders 30, 31 and printing-forme cylinders 40, 41, when, in each case, a modular positioning unit according to the invention for a universally usable cleaning and erasing cassette 10 is permanently assigned in the printing machine to the 10 is corresponding cylinder.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An erasing and cleaning device for printing machine cylinders comprising:

a cassette package, said cassette package including a cleaning cloth, and cloth transport means, said transport means including a fresh-cloth roll, a pressure roller for pressing cleaning cloth off-wound from said fresh-cloth roll against a cylindrical surface of a printing cylinder, and a dirty-cloth roll for roll up winding spent cleaning cloth, said cassette package further including a transport device disposed in a cloth travel path between the fresh-cloth roll and the pressure roller, and another transport device disposed in a travel path between the pressure roller and dirty-cloth roll, mechanical gripping means on said transport devices for gripping said cleaning cloth to transport said cleaning cloth, and drive means for synchronously driving said transport devices, wherein said transport devices each comprise a pair of opposed belts, the cleaning cloth traveling being between said opposed belts and a positioning unit, said positioning unit including a running mechanism having a drive for the cassette, said drive being controlled by a computer program so as to execute an intermittent feed of the cleaning cloth and a partial return of the cleaning cloth after a cleaning operation, said positioning unit being permanently affixed as a module in the printing machine for exchangeably securing the cassette in a working position on the printing machine.

2. An erasing and cleaning device according to claim 1, wherein the cleaning cloth comprises high wet tenacity fibrous fleece with non-polar substance intrinsic absorption capacity of 2 to 10 ml per g of cloth.

3. An erasing and cleaning device according to claim 2, wherein said intrinsic absorption capacity is 3 to 8 ml per g of cloth.

4. An erasing and cleaning device according to claim 1, comprising means for driving at least a first belt of each pair of belts in synchronism with said pressure roller.

5. An erasing and cleaning device according to claim 4, comprising means for driving a second belt of each pair of belts in synchronism with the first belt of said pairs.

6. An erasing and cleaning device according to claim 5, comprising means for driving said second belt of each pair of belts in synchronism with said pressure roller.

7. An erasing and cleaning device according to claim 1, wherein said positioning unit comprises a slide affixed to the printing machine, a superstructure on said slide, said superstructure including opposed side walls and a cross member extending between said side walls, said cassette being removably insertable in said superstructure, the drive for said cassette being articulated on said positioning unit.

8. An erasing and cleaning device according to claim 7, wherein drive for the cassette is coupled thereto through the dirty-cloth roll.

9. An erasing and cleaning device according to claim 7, comprising a nozzle head carried movably on said cross member for movement parallel to a printing cylinder cylindrical surface for supply of a cleaning agent for cleaning of said surface.

10. An erasing and cleaning device according to claim 1, further comprising sensing means operable to detect a presence of a stock of the cloth on the fresh-cloth roll when the cassette is inserted in working position.

11. An erasing and cleaning device according to claim 7, wherein the cassette is positionable in the positioning unit such as to provide at least two different positionings of the cleaning cloth against the cylindrical surface of the printing cylinder.

12. An erasing and cleaning device according to claim 1, further comprising means, provided in the printing machine, for supplying a cleaning fluid for at least one of removing an image from the printing cylinder surface and hydrophilizing the cylinder surface.

13. An erasing and cleaning device according to claim 11, wherein the positioning unit is configured so that the cassette is secured in the working position, relative to a surface being cleaned, at one of above and below a direct horizontal connection between center points of the printing cylinder and the pressure roller.

14. An erasing and cleaning device according to claim 1, wherein said pressure element is a roller and has an elastomeric covering.

15. An erasing and cleaning device according to claim 14, wherein the pressure roller covering has a roughness R between 0.4 and 35 um (white-light interferometer).

16. An erasing and cleaning device according to claim 14, wherein the pressure roller covering has a Shore hardness of between 30 and 80 and is substantially pore-free.

17. An erasing and cleaning device according to claim 1, wherein the cleaning cloth is transportable in a movement relative to a movement of the cylinder surface with the cylinder surface rotatable at a speed of 5 to 55 RPM.

18. An erasing and cleaning device according to claim 1, wherein the cleaning cloth comprises high wet tenacity fibrous fleece with a liquid substance intrinsic absorption capacity of 1–20 ml per g of cloth.

19. An erasing and cleaning device according to claim 18, wherein said intrinsic absorption capacity is 2 to 5 ml per g of cloth.

20. An erasing and cleaning device according to claim 1, wherein the cleaning cloth comprises high wet tenacity fibrous fleece with a polar substance intrinsic absorption capacity of 1 to 8 ml per g of cloth.

21. An erasing and cleaning device according to claim 20, wherein said intrinsic absorption capacity is 2 to 6 ml per g of cloth.

* * * * *